US008628607B2

(12) United States Patent
Rao

(10) Patent No.: US 8,628,607 B2
(45) Date of Patent: Jan. 14, 2014

(54) VACUUM PUMP SUCTION FILTER MEANT FOR COLLECTING IMPURITIES FROM FUNCTION

(76) Inventor: Yadapalli Kondala Rao, Mohopada (IN)

( * ) Notice: Subject to any disclaimer, the term of this patent is extended or adjusted under 35 U.S.C. 154(b) by 360 days.

(21) Appl. No.: 12/866,725

(22) PCT Filed: Feb. 9, 2009

(86) PCT No.: PCT/IN2009/000091

§ 371 (c)(1),
(2), (4) Date: Aug. 6, 2010

(87) PCT Pub. No.: WO2009/109995

PCT Pub. Date: Sep. 11, 2009

(65) Prior Publication Data

US 2010/0326549 A1 Dec. 30, 2010

(51) Int. Cl.
*B03C 3/36* (2006.01)

(52) U.S. Cl.
USPC ..... 96/63; 96/64; 96/79; 96/88

(58) Field of Classification Search
USPC ..... 96/63, 64, 77–79, 88; 417/151–154
See application file for complete search history.

(56) References Cited

U.S. PATENT DOCUMENTS

| | | | | |
|---|---|---|---|---|
| 1,507,687 | A * | 9/1924 | Schmidt | 95/79 |
| 2,377,391 | A | 6/1945 | White | |
| 3,425,189 | A * | 2/1969 | Haselmayer | 96/64 |
| 3,733,785 | A * | 5/1973 | Gallaer | 96/64 |
| 3,782,816 | A | 1/1974 | Costanza | |
| 3,782,861 | A | 1/1974 | Abe | |
| 3,915,672 | A | 10/1975 | Penney | |
| 4,294,591 | A * | 10/1981 | Kahl | 96/43 |
| 4,569,684 | A * | 2/1986 | Ibbott | 96/79 |
| 4,578,088 | A * | 3/1986 | Linscheid | 95/78 |
| 5,006,134 | A * | 4/1991 | Knoll et al. | 96/88 |
| 5,055,118 | A | 10/1991 | Nagoshi | |
| 5,085,673 | A | 2/1992 | Bentley | |
| 5,156,658 | A * | 10/1992 | Riehl | 96/64 |
| 5,224,809 | A | 7/1993 | Maydan | |
| 5,368,635 | A | 11/1994 | Yamamoto | |
| 5,700,134 | A | 12/1997 | Huntley | |
| 5,707,428 | A * | 1/1998 | Feldman et al. | 96/54 |
| 5,776,216 | A | 7/1998 | Yang | |
| 6,206,970 | B1 | 3/2001 | Atwell | |
| 6,508,861 | B1 * | 1/2003 | Ray | 95/79 |
| 6,620,224 | B1 * | 9/2003 | Sato | 96/83 |
| 6,635,106 | B2 * | 10/2003 | Katou et al. | 96/67 |
| 6,888,713 | B2 | 5/2005 | Stamps | |

(Continued)

FOREIGN PATENT DOCUMENTS

| | | | |
|---|---|---|---|
| GB | 1515275 | A | 6/1978 |
| WO | WO/2007/140882 | A | 12/2007 |

OTHER PUBLICATIONS

International Search Report, WO/2007/140882, (Aug. 20, 2009).

*Primary Examiner* — Richard L Chiesa

(57) ABSTRACT

The invention relates to a system wherein the fluid stream from an object to be evacuated is filtered before it enters into the vacuum pump with the maximum purity to the level of 99% and up to the particle size of 0.3 microns with minimum pressure difference thereby improving the life cycle of pump and performance of system.

8 Claims, 10 Drawing Sheets

(56) References Cited

U.S. PATENT DOCUMENTS

| | | | | |
|---|---|---|---|---|
| 2001/0039877 | A1* | 11/2001 | Hein | 95/69 |
| 2003/0159585 | A1* | 8/2003 | Gittler | 96/64 |
| 2004/0226449 | A1* | 11/2004 | Heckel et al. | 96/88 |
| 2006/0228272 | A1 | 10/2006 | Watson | |
| 2006/0276049 | A1 | 12/2006 | Bailey | |
| 2007/0172361 | A1 | 7/2007 | Manson | |
| 2007/0201988 | A1 | 8/2007 | Wilder | |
| 2007/0231162 | A1 | 10/2007 | Huntley | |
| 2009/0114092 | A1 | 5/2009 | Bengtsson | |

* cited by examiner

VACUUM PUMP SUCTION FILTER MEANT FOR COLLECTING IMPURITIES FROM FUNCTION

CROSS REFERENCE TO RELATED APPLICATIONS

This application is the U.S. national phase of PCT Application No. PCT/IN2009/000091, filed Feb. 9, 2009, which claims benefit of India Patent Application 295/MUM/2008, filed Feb. 11, 2008, the entire content of each of which is hereby incorporated by reference in this application.

BACKGROUND OF THE INVENTION

1. Field of the Invention

The invention relates to a method and system wherein the fluid stream from an object to be evacuated is filtered before it enters into a vacuum pump with maximum purity of 99% and up to a particle size of 0.3 microns with a minimum pressure difference, thereby improving the life cycle of pump and process performance of the system.

2. Description of Related Art

A vacuum is a negative pressure condition created to remove gas molecules from a process work chamber with the object of providing a clean work space free of gases that effect product quality and process performance. Vacuums are is used in numerous industrial products, processes and applications like lighting products, drying of chemicals, vacuum conveying systems, electronic industry, semiconductor processes, food and pharmaceutical processes, reactors, picture tube manufacturing processes etc. To evacuate the process chambers different kinds of vacuum pumps are used depending on vacuum level.

Vacuum pumps are divided mainly in four major categories as under a) Rough Vacuum—760 to 1 Torr (typical pumps used are roots, screw diaphragm and claw pumps among others)

b) Medium Vacuum—1 to 0.001 Torr (typical pumps used are oil sealed and piston type pumps)

c) High Vacuum—0.001 to 10 sup(−7) torr (typical pumps used are diffusion and turbo molecular pumps)

d) Ultra High Vacuum—pumps used for less than 10 Sup (−7) torr.

The above vacuum pumps are used to evacuate all work chambers/objects in order to get desired results for product, process & performance as per process requirements.

In this process of evacuation there are always chances that small quantities of dust, mist, chemical fumes or foreign materials will enter the vacuum pump's chamber thereby increasing the chances of wear and tear of all moving parts of pumps. These foreign materials will contaminate the pumps; oil and water and thereby reduce their efficiency and efficacy enormously. Oil ring vacuum pumps therefore require periodic oil replacements to maintain pump performance. If the foreign particle size is, then these same particles will not only have an impact on the mechanical performance of all moving parts in all types of pumps, but would also increase the maintenance cost of pump due to wear and tear of all moving parts and would also increase power cost. If oil is contaminated the vacuum pump's performance will come down drastically and it would fail to serve its intended purpose.

In some processes where the contamination from the process is high, users generally go for water ring vacuum pumps as these impurities from process will mix with sealing water and then would be discharged out along with water. However these water ring vacuum pumps would generally consume more power and delivers lesser vacuum as compared to oil ring vacuum pumps and would also generates lot of water effluent.

To avoid the problems of impurities in vacuum pumps now a days dry/screw type vacuum pumps have been developed which can generate 0.1 torr with additional booster pumps and are available in markets but are quite expensive. Screw type vacuum pumps also have limitations about dust load. In such cases also periodic cleanings are needed as explained in US Patent Application No. 20070172361.

Other than this if dangerous chemicals or other non environment friendly foreign materials enter into the oil there will be problems with disposal of oil when contaminants endanger to the environment and society. When such oil is disposed it may effect the environment very badly if the disposed oil is not handled properly or recycled properly.

Water ring vacuum pumps can take ample amounts of dust and fumes load from process effectively as compared to oil ring/dry screw/claw type vacuum pumps. Water ring vacuum pumps however consume more power and an auxiliary water pump is required to feed the water in to vacuum pump and finally water ring vacuum pumps will deliver less vacuum than that by oil ring vacuum pumps. Over and above this the water also required to be get cooled in cooling towers and handling this contaminated water is an issue especially where contamination is high. If the water is not handled or treated properly the quality of the water will effect the environment.

There are steam ejector type vacuum pumps also available which can deliver up to 0.1 Torr with two or more pumps in series arrangement. However, these pumps require a lot of heat to generate steam and again the steam contaminated with foreign materials produce bad quality steam condensate and this will increase the hardness of water. If same condensate is re-circulated through the boiler it leads to lot of scaling and further contributes to the reduction in thermal efficiency of the boilers.

To filter the fluid stream there are some mechanical filters which are in use at present. There are the following likely drawbacks to using the same filters on vacuum pump suction lines.

a) Heavy pressure drops and therefore the vacuum pressure difference is more.

b) High conductance drops c) Frequent chocking/replacements of filters.

d) Increase of cycle times e) Reduction in ultimate vacuum level f) Indication for filter choking is very difficult and therefore expensive.

g) Ordinary mechanical filters can't filter the oil, mist effectively, h) Mechanical filters can work up to 5 microns effectively.

There are lot of different types of traps to trap liquid fumes entry in to vacuum pumps like refrigerant traps, liquid nitrogen traps etc. These are very expensive and have high operating costs.

Normally in the wine processing industry the air stream towards the vacuum pump is heated up to 110° C. to kill the bacteria which is going out from the vacuum pump. Otherwise all bacteria will go out and effect the environment badly. In this process of heating a lot of electrical energy is needed to heat the air flow.

Diffusions pumps are made available for vacuum levels up to 1×10 sup (−10) torr for high vacuum applications. These pumps face the problem of oil back streaming into the process chamber or product to be evacuated. This back streaming of oil in PPM (Parts per Million) levels will effect process performance and/or product quality very badly. The same are discussed in detail in U.S. Pat. No. 3,782,816 and U.S. Pat. No. 5,700,134.

In any process of productions where steps involves reactions, melting, crystallizations, coatings, filling, drying, fermentation in a vessel for further processing a particular pressure is necessarily required to be carried out in vacuum. Thus the specific gravity of gas which flows into the vacuum pump is very small. When the gas together with other constituents flows into the vacuum pump, the gas flows appropriately but the crystallization in the vessel for processing prevent the reaction or reduced ability to convey other constituents which includes substantially the dust particles and therefore dust is accumulated in the vacuum pump. There are several inventions, which deal with this difficulty and have been able to reduce the amount of accumulated dust but how ever could not facilitate the satisfactory running of the vacuum pump and thereby require frequent operations to remove the dust in the vacuum pump.

To prevent dust from flowing into vacuum pumps attempts have been made to separate the dust by providing filters/cyclone separators, traps and traps in series or the like between the vacuum pump and the dust producing device however there was not a complete solution because dust causes blocking of through-parts in the filter, the efficiency of which are then greatly reduced. The effective evacuation performance of the vacuum pump for the process of production by reaction, melting and crystallization vessel for processing prevents the reaction process, the melting process and the crystallization process on a continuous basis.

For any process performances which are to be performed in vacuum, their efficiency/effectiveness, productivity and product quality is are dependent on the vacuum level achieved in any such process. If foreign materials, fumes and dust and mist enters in vacuum pump it will reduce vacuum level and same will effect over all performance of the process. If dust enters into any vacuum pump in the middle of the process cycle, the pumping capacity of vacuum pump will come down and this will increase the cycle time or reduce process performance.

Vacuum pump pumping capacity depends on conductance of pipe lines and restrictions, if any. For example if the vacuum pump has a capacity of 100 Liters per minute (LPM) and if there is a restriction in pipe line the vacuum pump would conduct only 90 Liters per minute (LPM) the net pumping capacity of said vacuum pump would thus be restricted to 90 Liters per minute (LPM). On account of this problem people will not prefer to install any kind of mechanical filters where process vacuum is more important than maintenance of vacuum pumps.

To work in a dusty/fumes environment, process of evacuation suitable pumps are water jet/water ring/steam jet (single stage/multiple stage) vacuum pumps; these pumps can take the load of impurities from process but the draw back in these systems are:

I) Inefficient compared to other systems oil ring screw type vacuum pumps.

II) Generates low vacuum levels than oil ring vacuum pumps

III) Generates lot of effluent because mixing of fumes/dust in sealing fluid stream (sealing fluid is steam in case of steam jet vacuum pumps and water in case of water ring and water jet vacuum pumps).

IV) Consume more electric power.

V) Consumes more steam.

Various other improvement have been suggested such as:

U.S. Pat. No. 5,776,216: A vacuum pump filter for filtering debris from a semiconductor(s) system is disclosed. The vacuum pump filter includes an inlet port for connecting to a chamber. A first filter holder is connected to the inlet port for filtering large debris. A second filter holder for filtering middle debris is connected to the first filter holder. A third filter holder is connected to the second filter holder for filtering small debris. A outlet port is connected to the third filter holder via a terminal. The other terminal of the outlet port is connected to a pump system.

United States Patent Application #: 20060276049

Title: High efficiency trap for deposition process

Abstract: The present invention provides a system, apparatus and method for improving the efficiency of a semiconductor(s) processing system, such as a deposition system by decreasing or substantially eliminating the accumulation of by-products in the apparatus components of the semiconductor(s) processing system. The present invention further relates to improving the efficiency of a fore line trap associated with a semiconductor(s) processing system, wherein the trap removes substantially all of the by-products from the exhaust gas from the processing chamber. In addition, the present invention provides a system, apparatus and method for efficiently clearing traps of accumulated by-products from exhaust gas of a semiconductor(s) processing system.

Device and method to mitigate hydrogen explosions in vacuum furnaces

U.S. Pat. No. 6,888,713

Abstract:

A device to mitigate hydrogen explosions in a vacuum furnace includes at least one igniter, an ignition transformer, and an electrical switch. The at least one igniter includes a set of high-voltage Electrode(s)s and is connected to the ignition transformer by high-voltage wires. The electrical switch activates the ignition transformer to provide power to the at least one igniter forming a continuous electrical arc between the Electrode(s)s. The at least one igniter is located inside the vacuum furnace at an opening where air may enter the vacuum furnace, which may contain a hydrogen and steam gas mixture under accident conditions. The device consumes hydrogen by controlled combustion as flammable mixtures are formed.

United States Patent Application #: 20070231162

Title: Vacuum pump

Abstract: A multi-stage vacuum pump comprises, between adjacent stages of the pump, a continuous ignition source for igniting a fuel within a pumped fluid. This can ensure that the concentration of the fuel in fluid exhaust from the pump is below its lower explosive limit.

United States Patent Application #: 20070201988

Title: Vacuum pump

Abstract: A vacuum pump comprises a rotor assembly mounted on a driven shaft, and a motor for rotating a drive shaft in forward and reverse directions. A driven member is located on the driven shaft and a drive member is located on the drive shaft for engaging the driven member to couple the driven shaft to the drive shaft. Each member has first and second impact surfaces. The members are configured to permit at least one quarter of a revolution of the drive member relative to the driven member in either the forward or the reverse direction before one of the impact surfaces of the drive member impacts upon a corresponding impact surface of the driven member. This can enable the drive member to acquire sufficient angular momentum before it impacts the driven member such that the amount of energy transferred to the driven shaft upon impact can be sufficient to free a pump that has become locked by process deposits. In the event that the pump is not restarted "first time", the motor direction can be reversed to bring the other impact surfaces into contact with the same angular momentum. This sequence can be repeated as required until the pump restarts.

United States Patent Application #: 20060228272

Title: Purifier

Abstract: A purifier is described for use in a gas processing application. The purifier comprises a chamber having a gas inlet and a gas outlet. A series of baffles are arranged in the chamber and coated with a getter material selected for its ability to react with species to be removed from a gas stream and form stable compounds. The chamber also houses a source of the getter material, which is periodically activated to refresh the coating of getter material on the baffles.

U.S. Pat. No. 3,782,861

Abstract: An oil diffusion pump which has a plurality of coaxially arranged cylindrical chimneys extending from the bottom of a cylindrical envelope. The bottom of said envelope has hollow projections extending upwardly between the chimneys and a heating element has portions thereof extending into said hollow projections.

U.S. Pat. No. 5,700,134—Diffusion pumps

Abstract: A diffusion pump is provided with an outer body and a chimney positioned within the outer body. A top cap is positioned about the top of the chimney to form an annular passageway (or an annular array of passageways) there between. A guard ring is positioned generally above the top cap. Coolers cool the outer body and the guard ring and working fluid present in the base of the outer body is heated to cause evaporated oil to pass up the chimney. A baffle, substantially thermally isolated from the guard ring, is contained within the outer body.

U.S. Pat. No. 2,377,391 (1945) to White discloses one of the earliest inventions regarding electronic air cleaners. A method and apparatus of charging suspended particles in air is taught. Once charged, a separate precipitator removes the particles. Broadly speaking, the invention comprises increasing the strength of the electric field between a discharge and a non-discharge Electrode(s) in the portion of the field adjacent the non-discharge Electrode(s). This may advantageously be effected by providing a previous, non-discharging auxiliary or grid Electrode(s) member between the discharge Electrode(s) and non-discharge Electrode(s), and maintaining a substantially greater potential difference per unit of spacing between the auxiliary Electrode(s) and non-discharge Electrode(s) than between the discharge Electrode(s) and the auxiliary Electrode(s). The auxiliary Electrode(s) is maintained at a potential between that of the discharge Electrode(s) and that of the non-discharge Electrode(s), so that the polarity of the field between the discharge Electrode(s) and the auxiliary Electrode(s) is the same as that of the field between the auxiliary Electrode(s) and the non-discharge Electrode(s).

U.S. Pat. No. 3,915,672 (1975) to Penney discloses an electrostatic precipitator having parallel-grounded plate Electrode(s) dust collectors. High voltage corona wires are located between the plate Electrode(s)s. They charge the dust particles, which are then drawn to the plate Electrode(s)s. The corona wires are pulsed in order to prevent back-corona which otherwise occurs due to the high resistivity of the dust accumulation on the plate Electrode(s)s.

U.S. Pat. No. 5,055,118 (1991) to Nagoshi et al. discloses an electrostatic dust collector. A first positive ionization Electrode(s) positively ionizes the dust. Then the dust passes into a chamber having a pair of un-insulated Electrode(s)s at a high voltage, separated by an insulation layer. Coulomb's law causes the dust to collect on the grounded Electrode(s), thereby neutralizing the charge of the dust particles. The dust only collects on the grounded Electrode(s) due to special gaps in the laminate, which prevents dust build-up on other components. The theory is that dust accumulation on only the grounded Electrode (s) does not cause significant deterioration of the electric charge due to the neutralization by the dust particles. However, it is clear that cleaning of the negative Electrode(s)s is necessary to maintain airflow.

BRIEF SUMMARY OF THE INVENTION

By using our unique filter the effluent generation will come close to zero and also vacuum levels can be improved with over all energy savings up to 25%. The vacuum levels can also be improved by more than 8% from that of existing water ring and steam ejector vacuum pumps by replacing these pumps with any type oil ring vacuum pumps along with filter.

One of the objects of the invention is to safeguard all types of vacuum pumps (as explained above) from contamination from dust, mist and gaseous particles by providing a unique kind of filter which operates on electrostatic precipitation principles. It is also an object of the invention to provide low cost Ultra High vacuum pressure electro static filter, which can filter effectively up to 0.3-micron size. It is an object of the invention to provide electro static filter for all kinds of vacuum pumps up to ultra high vacuum pumps. (on line cleaning)

DETAILED DESCRIPTION OF THE INVENTION

The electrostatic precipitation principle is used to filter all dust, mist, oily & gaseous particles on vacuum pump suction line to filter fluid stream which is going towards the vacuum pump to safe guard vacuum pumps from contamination from dust, mist & gaseous particles.

Also by additional fixtures like flame proof panels and flame proof fixtures the same filter can effectively be used in a flame proof environment like solvent recovery systems, semi conductor(s) process systems, in bulk drugs and pharmaceuticals and in semi-conductor(s) processes where fumes explosive in nature are coming from process towards the vacuum pump.

Figure 3:
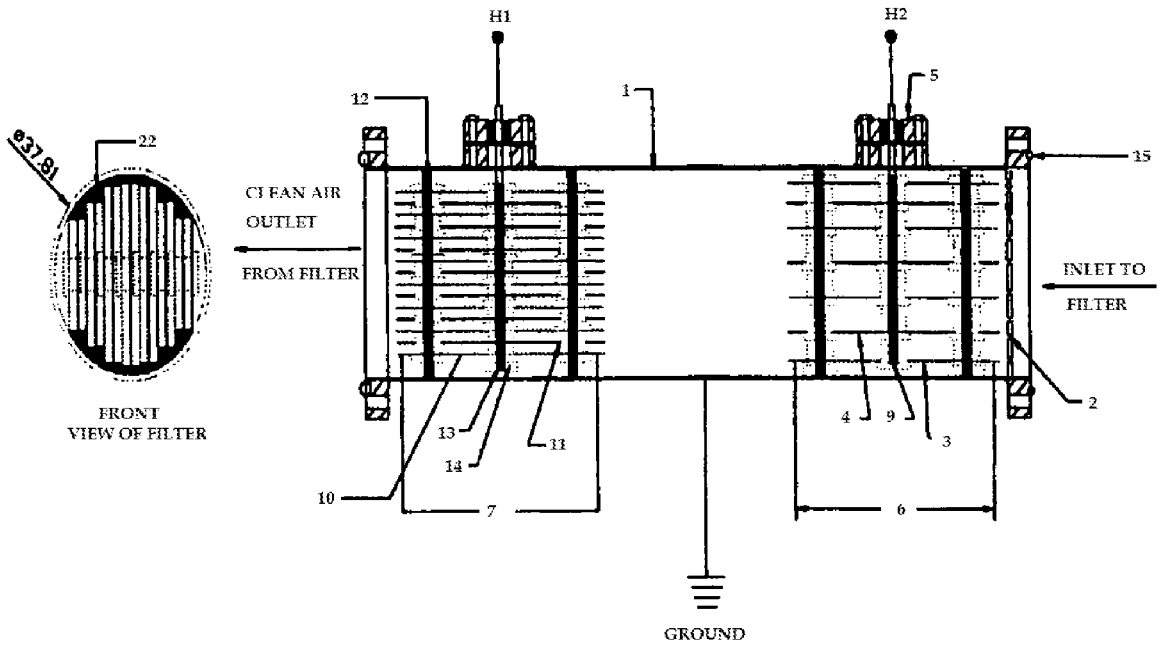
FIG. 3 Filter construction/detailed drawing

And to increase the area of collection electrode(s) and to improve filter efficiency the main external housing with flanged end (1) is connected to collection negative/grounded electrode(s) and same grounded connection is shown in FIG. 3.

Figure 4:
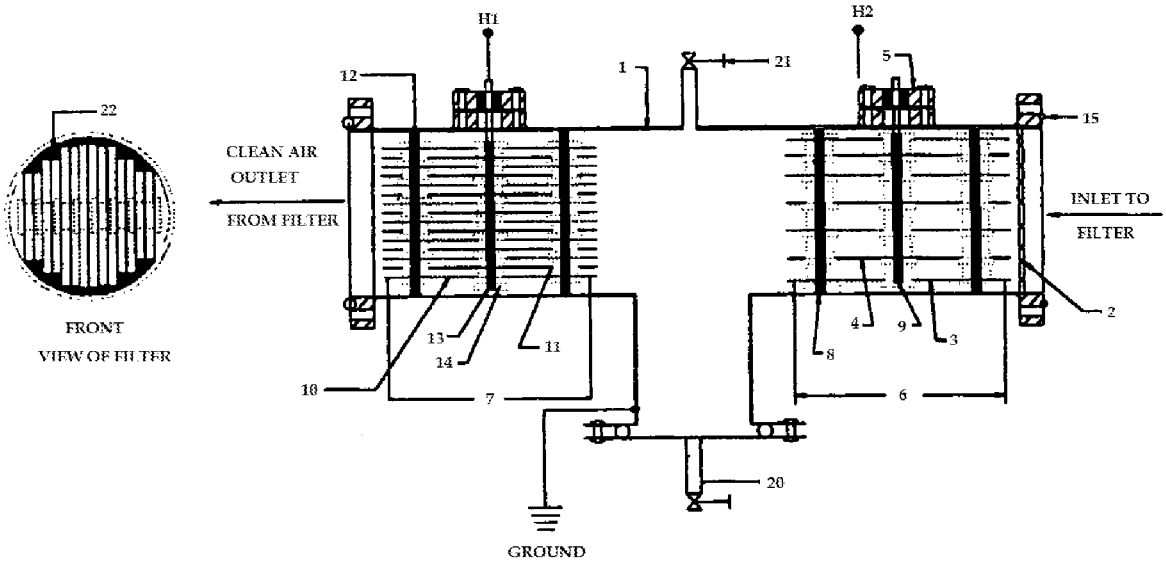
FIG. 4 Filter construction/detailed with on line cleaning draining system

And to increase the filter cleaning period and to have a more grounded collection area for fumes and collectants which are in liquid form a separate trap with drain valve (20) as shown in FIG. 4 can be provided.

Where fumes generation is very high and little time is available for filter cleaning, a separate cleaning fluid inlet valve (21) can be provided to clean filter while filter is in assembled condition on main pipe line as shown in (FIG. 4) with Drain valve (20) to drain cleaning fluid from cleaning process.

Figure 1:
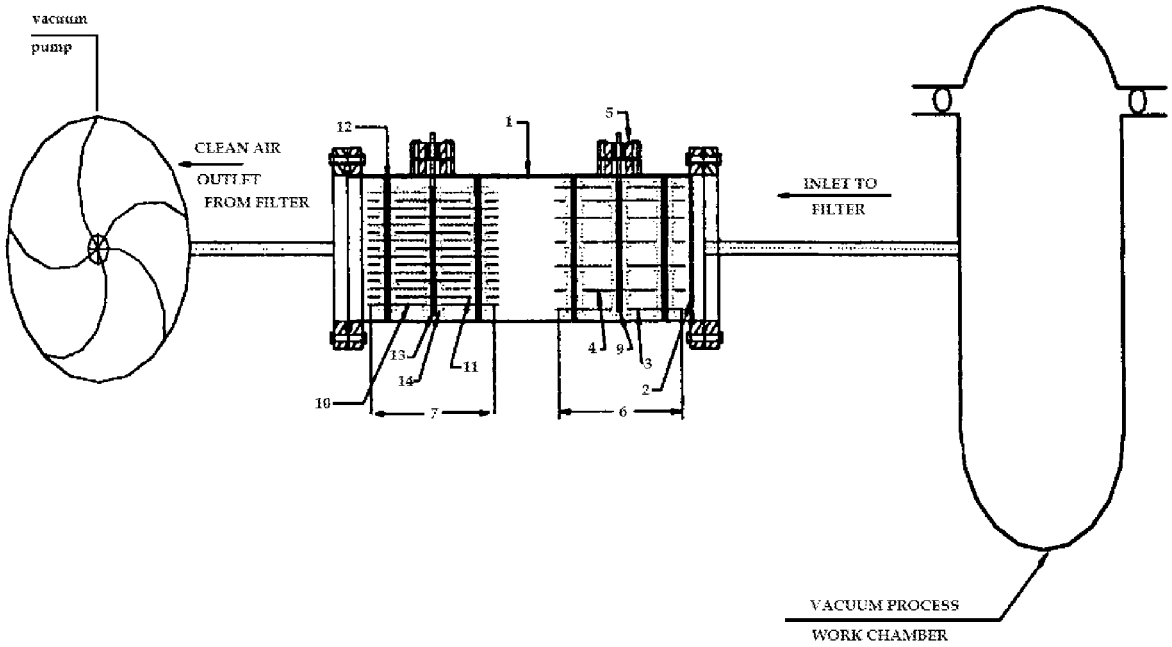
FIG. 1 Schematic lay out of vacuum pump and filter installation

Referring to Sectional View of Vacuum Line electrostatic filters (FIG. 1) it contains the following items:

1) external housing tube with flange end (1) 2) gas distributor (2)
3) ionization zone negative/grounded electrode(s) (3)
4) ionization zone positive electrode(s) (4)
5) glass to metal or ceramic to metal/rubber to metal seal(s) (5)
6) ionization zone (6)
7) collection zone (7)
8) ionization zone negative electrode supporter/conductor(s) (8)
9) ionization zone positive electrode supporter/conductor(s) (9)
10) collection zone negative/grounded electrode(s) (10)
11) collection zone positive electrode(s) (11)
12) collection zone negative electrode supporter/conductor(s) (12)
13) collection zone positive electrode supporter/conductor(s) (13)
14) bush(es) (insulator/holder) (14)
15) O-ring(s) (15)
16) flame proof panel (16)
17) flame proof fixture(s) (17)
18) vacuum pressure sensor (18)
19) controller (19)
20) drain valve (20)
21) cleaning fluid inlet valve (21)
22) insulator/retainer(s) (22)
23) cable entry for flame proof fixture (23)
24) Ionization zone power supply cable H2 (24)
25) collection zone power supply cable H1 (25)
26) negative/grounded electrode connecting cable (26)
27) input signal from vacuum pump (27)

External Housing Tube with Flange End (1)

External housing tube with flange end (1) is made up of MS, SS316, Inconel, Hastalloy with flange ends on both sides for easy mounting on a vacuum line and the same metal pieces are welded on top to fix the glass to metal or ceramic to metal/rubber to metal seals (5) with O-rings (15) for hermitically sealing to avoid any vacuum leakages up to a vacuum level of 1×10sup (−6) torr.

Gas Distributor (2)

This is made up of insulated materials with high dielectric strength like nylon, glass filled nylon, plastics, teflon etc. to avoid accidental short circuiting and to distribute the stream of air flow from the work chamber equally, and the same having hallowed slots to distribute flow equally across filter.

Ionization Zone Negative/Grounded Electrode(s) (3)

This is a negative electrodes made up of aluminum, SS316, steel or nickel alloys, Hastalloys, Inconel alloys and same are electrically insulated from ionization zone positive electrode(s) (4) and same are electrically connected to external housing tube with flange end (1) and are supported by ionization zone negative electrode supporter/conductor (s)(8).

Ionization Zone Positive Electrode(s)(4)

Figure 10:
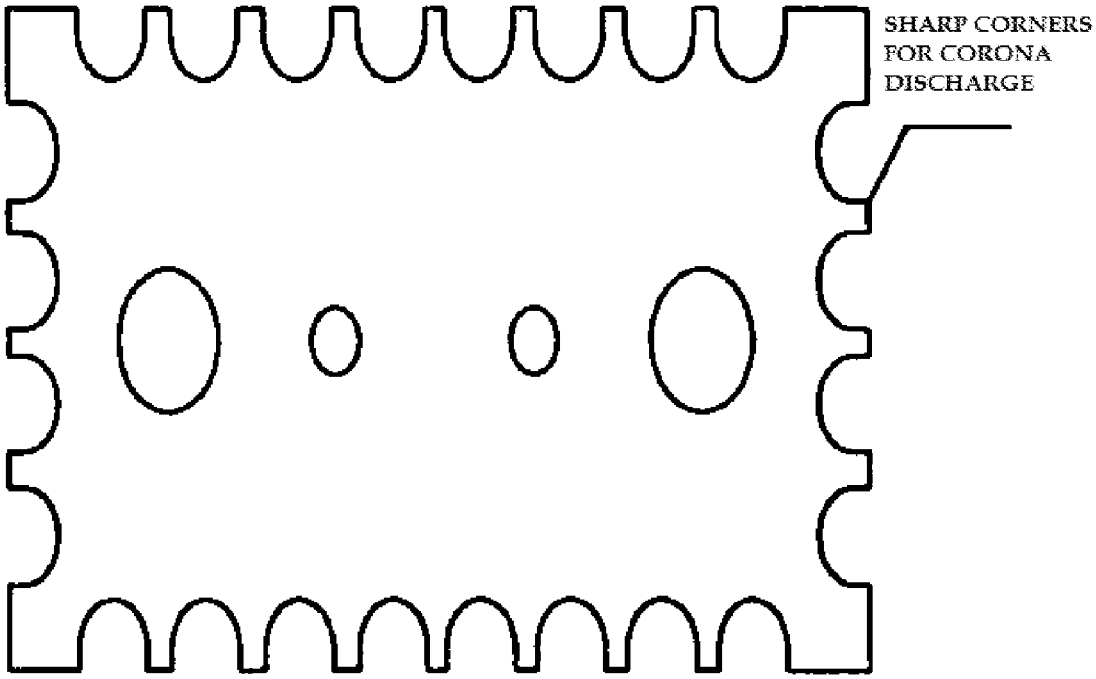

This is an electrode(s) made up of aluminum, SS316, steel or nickel alloys, Hastalloys, Inconel alloys and same are electrically insulated from ionization zone negative/grounded electrode(s) (3) and connected to glass to metal or ceramic to metal/rubber to metal seals (5) with ionization zone positive electrode(s) supporter/conductor(s) (9) to pass the high voltage DC through electrodes. These electrodes have sharp corners edges as shown in FIG. 10 to produce a corona effect to ionize/charge all particles which is are passing through and kept horizontally to increase ionization time and improve filter efficiency.

Glass to Metal Or Ceramic to Metal/Rubber to Metal Seals (5)

This is electrically insulated with glass/rubber/ceramic between the main body and feed through rod and also hermitically sealed up to a vacuum level of 1×10sup(−6) torr. Through this high voltage DC current will flow to create corona and charge particles passing through. Total quantity is two, one is connected to ionization zone (6) and one is connected to collection zone (7) to supply high voltage currents to positive electrodes in both zones separately.

Ionization Zone (6)

This is zone comprises ionization zone positive electrode(s)(4), ionization zone negative/grounded electrode(s) (3), ionization zone negative electrode(s) supporter/conductor(s)(8), and ionization zone positive electrode(s) supporter/conductor(s)(9) with bush(es) (insulator/holder) (14) to insulate electrode(s) and to charge/ionize particles which is passing through along with air.

Collection Zone (7)

This is zone comprises collection zone negative/grounded electrode(s) (10), collection zone positive electrode(s)(11), collection zone negative electrode supporter/conductor (s) (12), collection zone positive electrode supporter/conductor (s) (13), and bush(es) (insulator/holder) (14) insulator/retainer(s) (22) to collect dust and mist particles from process followed by ionization zone (6).

Ionization Zone Negative Electrode Supporter/Conductor(s) (8) & Ionization Zone Positive Electrode Supporter/Conductor(s) (9)

These are metal rod(s) made up of SS316, steel or nickel alloys, Hastalloys, Inconel alloys to electrically conduct between ionization zone negative/grounded electrode(s) (3) and ionization zone positive electrode(s)(4) respectively.

Collection Zone Negative/Grounded Electrode(s) (10)

This is a negative electrode(s) made up of aluminum, SS316, steel or nickel alloys, Hastalloys, Inconel alloys same are electrically insulated from collection zone positive electrode(s) (11) and same are electrically connected to external housing tube with flange end (1) to have more collection area and are supported by collection zone negative electrode supporter/conductor(s) (12) and are electrically insulated by bush(es)(insulator/holder) (14) from collection zone positive electrode(s) (11) to collect dust, mist particles from process.

Collection Zone Positive Electrode(s) (11)

This is a positive electrode(s) made up of aluminum, SS316, steel or nickel alloys, Hastalloys, Inconel alloys and same are electrically insulated from collection zone negative/grounded electrode(s) (10) and same are electrically connected glass to metal or ceramic to metal/rubber to metal seals (5) and are supported by collection zone positive electrode supporter/conductor (s) (13) bush(es) (insulator/holder) (14) and are electrically insulated by bush(es) (insulator/holder) (14) from collection zone negative/grounded electrode(s) (10). Insulator/retainer(s) (22) are inserted at edges of positive Electrodes to maintain equidistance between two electrodes and also electrically insulate from external housing tube with flange end (1) and negative electrodes from positive electrodes.

Collection Zone Negative Electrode Supporter/conductor(s) (12) & Collection Zone Positive electrode Supporter/conductor(s) (13)

These are metal rods made up of SS316, steel or nickel alloys, Hastalloys, or Inconel alloys to support electrode(s) and also electrically conduct between all collection zone negative/grounded electrode(s) (10), collection zone positive electrode(s) (11) respectively.

Bush(es) (Insulator/Holder) (14)

Is made up of high dielectric strength materials like Teflon, ceramic and/or of reinforced plastics to insulate both positive and negative Electrode(s) and also support physically both Electrodes to maintain equidistance between electrodes.

'O' Ring(s) (15)

This is made up of Viton, silicon, neoprene rubbers to seal all mating joints hermitically sealed up to vacuum level of 1×10 Sup(−6) torr. These O rings are at flange joints, glass to metal or ceramic to metal/rubber to metal seals (5) to avoid any leakages in the vacuum system.

Flame Proof Panel (16)

This is electrical control panel is normally made up of light weight aluminum or any reinforced plastics to mount all electrical transformers, relays, bridge rectifiers, control switchings etc to keep in safe environments and to avoid any accidental sparking of cath fire and to avoid any sort of explosion. The same panels are available in market as per safety requirements and as per industry standards and norms.

Flame Proof Fixture (17)

Is made up of light metal like aluminum alloys or reinforced plastics mounted on glass to metal or ceramic to metal/rubber to metal seals (5) to have hermitical sealing and also to with stand high positive pressure up to 10 Kg/cm2 to avoid any sort sparks coming out to catch fire if any flammable gas mixtures or traces present in atmosphere due to any leakages in any of system around area The design and safety standards are as per industrial norms and standards.

Vacuum Pressure Sensor (18)

This is a vacuum pressure sensor to measure the vacuum level inside the filter housing and send an electrical signal to the filter along with the vacuum pump ON signal to supply the high voltage DC supply to filter. Normally it has variable pressure settings as per standards and the setting can be done in range of 1 to 760 Torr. Preferably it is set at less than 45 Torr because at a vacuum pressure of 45 Torr or less for the majority of flammable gases and/or mixtures of gases ignition cannot occur at pressures lower than 60 mbar(45 Torr).

This system is required for fire-proofing and/or explosion proofing an area only as per safety and standards required.

Controller (19)

This will take signals from both vacuum pump and vacuum pressure sensor (18) and process both signals and send signals to the electrical source supply relay for the filter. This will shut off electrical power supply to the filter as a safety measure when 1) the vacuum pump is tripped or stopped due to any reason and/or 2) when the system pressure reaches more than 45 Torr vacuum pressure. This control system is needed only when the filter has to work in flame-proof or explosion proof environments only.

Drain Valve (20) & Cleaning Fluid Inlet Valve (21)

These are valves to clean the filter on line by draining the collectants from process and from cleaning and sending cleaning fluid when the system is stopped to clean the filter without dismantling from the main line.

Insulator/Retainer(s) (22)

Mounted on edges of collection zone positive Electrode(s) (11) preferably Made up of high di electric strength materials like Rubbers, Teflon, ceramic to maintain equi distance between both positive and negative Electrodes and electrically insulate with External Housing tube with Flange End (1).

Cable Entry for Flame Proof Fixture (23)

This is mounted with rubber bush(es) to with stand positive pressure to avoid electrical sparks to come out side in case of flame proof and explosive proof environments to avoid accidents. This is as per industrial standards and safety norms for flame proof and explosion proof environments.

Ionization Zone Power Supply Cable H2 (24) Collection Zone Power Supply Cable H1 (25)

This is a high-voltage cable with double or triple layer insulation to withstand high voltages up to 20000 V DC and to pass electrical currents for ionization and collection zones respectively.

Negative/Grounded Electrodes Connecting Cable (26)

Figure 2:
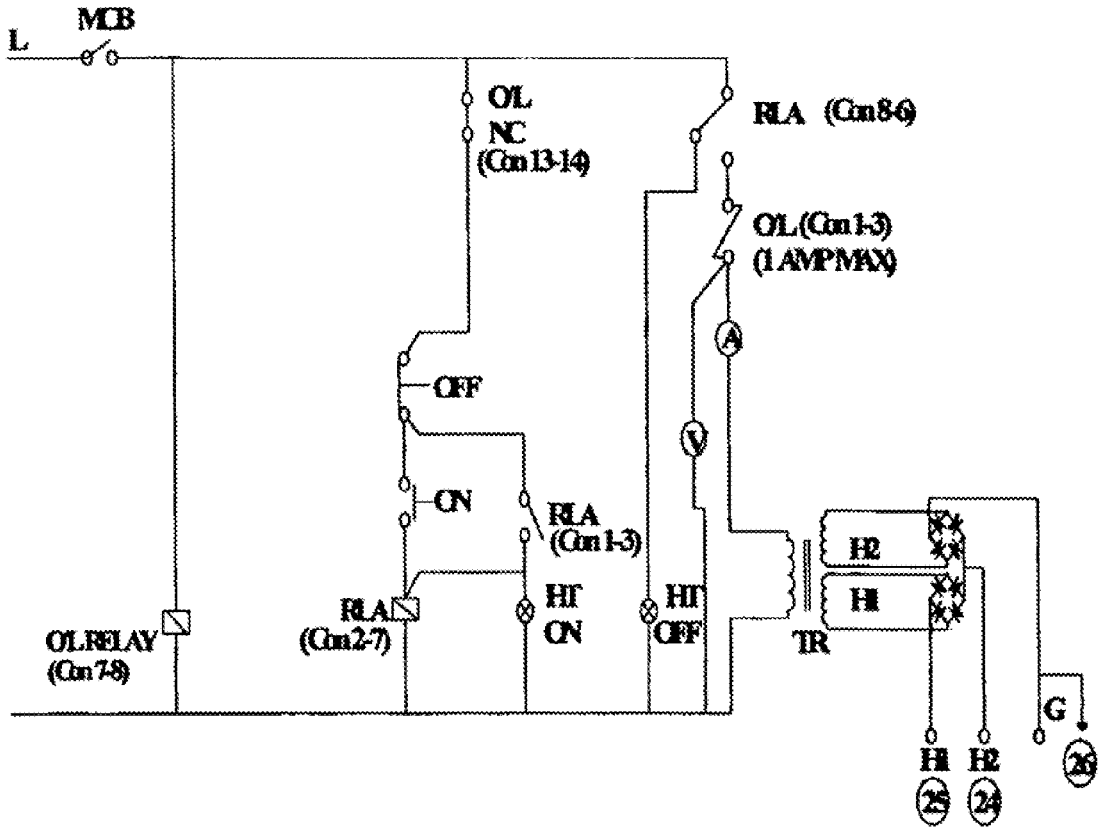
FIG. 2 Schematic electrical circuit drawings

This is a high-voltage cable with double or triple layer insulation to with stand high voltages up to 20000 V DC and to close circuit and ground the negative electrodes as shown in FIG. 2.

Input Signal from Vacuum Pump (27)

This is an electrical signal from the vacuum pump ON/OFF position, by processing this signal and also from vacuum pressure sensor (18) the electrical signal to filter will be processed by controller (19) as a safety measure for the filter to work in flame proof and explosion proof environments.

The fluid first passes through the ionization zone (6) which is covered by an insulated diverter (2) located on the internal side of external housing tube with flange end (1) which is hermitically sealed and tested at vacuum level of 1×10sup(−6) Torr. Diverter (2) is made of high dielectric strength materials like glass filled nylon or glass filled teflon or ceramic materials to avoid short circuiting of electrodes accidentally if it touches electrodes and to distribute the fluid stream equally between the set of parallel ionization zone negative/grounded electrode(s)(3) and ionization zone positive electrode(s) (4) to ionize all airborne particles like dust, mist, fumes and liquid particles along with the stream passing through equally spaced sets of electrode(s) supported by ionization zone negative electrode(s) supporter/conductor(s) (8) and ionization zone positive electrode(s) supporter/conductor(s) (9). These electrodes are connected to high DC voltage up to 12000 V DC through the glass to metal/ceramic to metal/rubber to metal seals (5) to work as a current carrier and also for hermitically sealing the filter up to a vacuum level of 1×10 (−6) torr and to pass high DC voltage current through positive electrodes to complete a circuit and to generate a corona effect to charge all air borne particles which are passing through. The corona configuration has been described clearly in FIG. (8). The long plate with corona discharge points in the direction of flow will contribute to improvement of filter efficiency up to particle size of 0.3 microns and also 99% efficiency.

Ionization positive electrode(s) is are simple metal electrode(s) with aluminum, steel, SS-316, Hast Alloys, Inconel Alloys, nickel alloys to the design size with serrations on all four sides to have sharp points to generate the corona effect to discharge corona to ionize all air borne particles as shown in FIG. 10.

The bush(es) (insulator/holder) (14) insulator/retainer(s) (22) will also work as an insulating media between both electrode(s) and physically supports electrodes to maintain equidistance between electrodes and electrically insulate positive electrode(s) between external housing tube with flange end (1) respectively.

Figure 5:
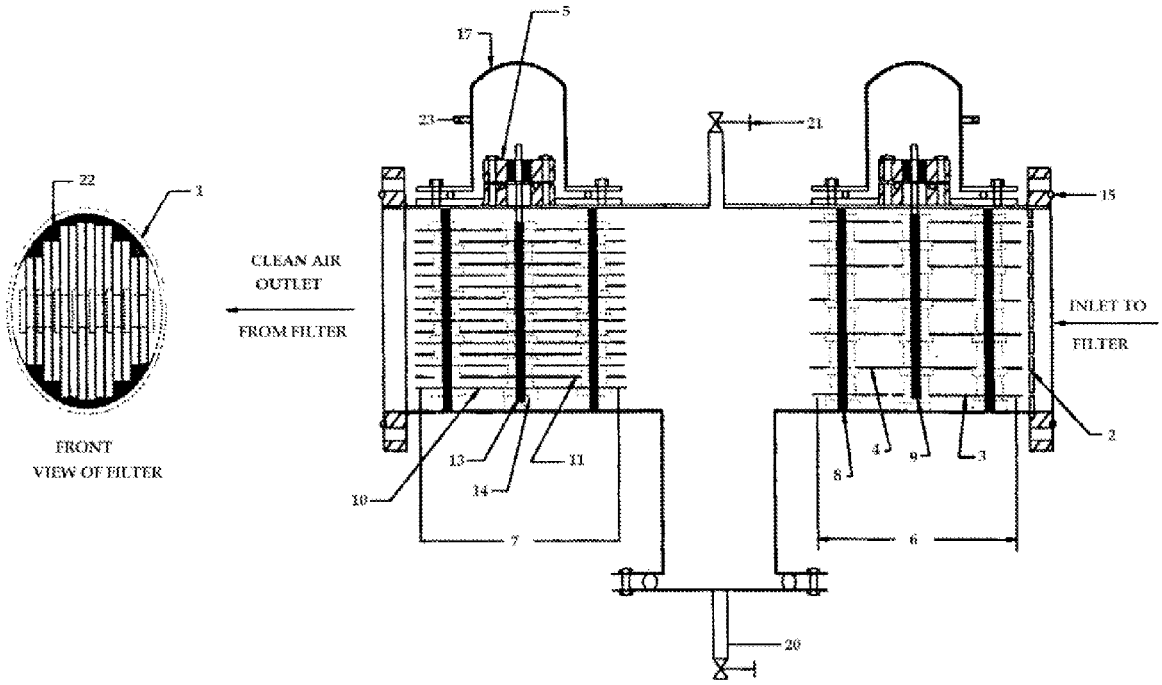
FIG. 5 Filter construction/detailed drawing for flame proof application
Figure 6:
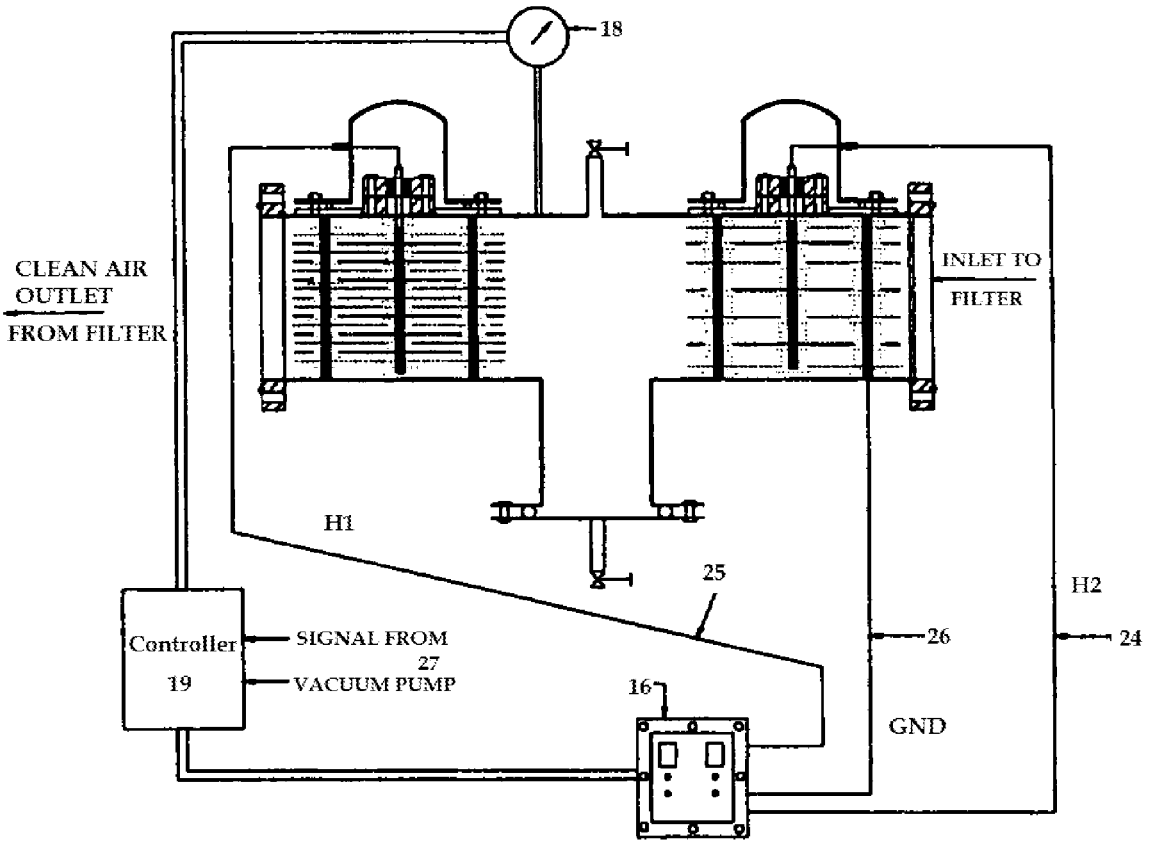
FIG. 6 Schematic circuit drawing for flame proof application

For these electrodes the power from an external source will be supplied up to 12000 V DC from a step up transformer and bridge rectifier as shown FIG. 2 and FIG. 6. The main power supply is connected to electrode(s) in ionization zone (6) and collection zone (7) through hermitically sealed glass to metal or ceramic to metal or rubber to metal seals (5) of quantity 2 placed on the outer chamber placed at both ends of filter external housing tube with flange (1) in FIG. 3 to FIG. 5 which was meant for to pass the electricity (high voltage DC) and also seal hermitically, sealing up to ultra high vacuum 1×10sup(−6) torr.

Then this fluid stream moves towards the collection zone (7) where the collection zone contains collection zone negative/grounded electrode(s) (10) and collection zone positive electrode(s) (11) which are supported by collection zone positive electrode supporter/conductor(s) (13) which are supported by collection zone negative electrode(s) supporter/conductor(s)(12) are made of steel, MS, nickel, Inconel vertically insulated with bush(es) insulator/holder (14) made up of (nylon/teflon/ceramic or any high dielectric strength materials) rods to hold properly and to maintain equal distance exactly as per design requirements and insulate both electrodes. These bush(es) spaced equidistant between positive and negative electrode(s) to insulate the electrode(s), physically support electrode(s) and also maintain equidistance between electrode(s) to electrode(s). Insulator/retainer (22) mounted on collection zone positive electrode (11) is meant for insulation and to maintain equidistance between both positive and negative electrode(s) and to avoid short circuits of positive electrode(s) and external housing tube with flanged end (1).

Positive electrode(s) (11) and all charged positive particles will move to collection zone negative electrode(s) (10). And some dust may adhere to collection zone positive electrode(s) (11) also as explained above all charged particles adhere to collection zone negative electrode(s) (10). Dust and mist and fumes also adhere and collect on the external housing tube with flanged end (1) hence it was thus it is connected to ground i.e. negative electrodes.

Fresh dust/fume free air will enter into the vacuum pump. The electrodes positive and negative will be coated with special coating at edges to avoid back corona and arcing, In such cases we can use higher voltages to improve filter performance in case of particle size up to or less than 0.3 microns and also efficiency of system to 99%. Installing 2 or more filters in services will improve filtration efficiency to 99.99%.

Figure 7:
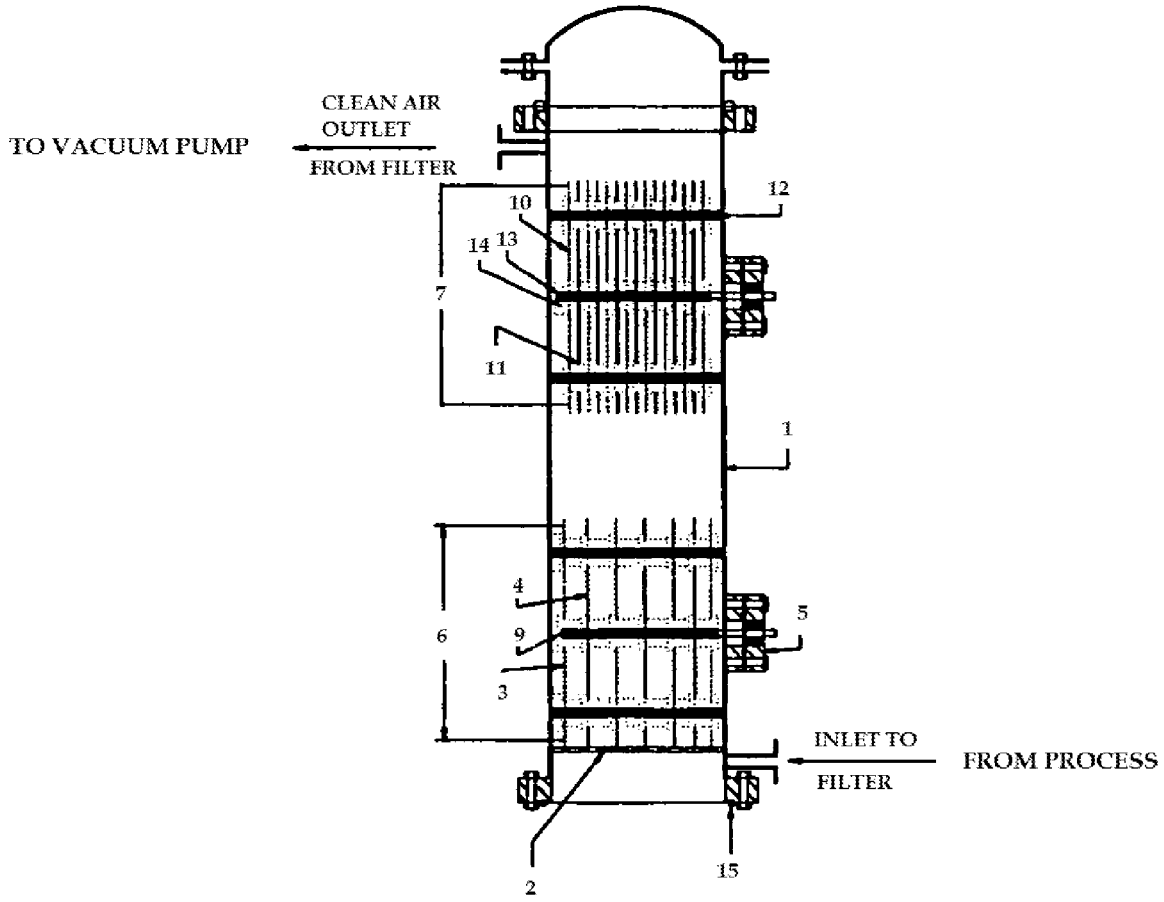
FIG. 7 Schematic drawing for high capacity filter (vertical) for bigger vacuum pumps FIG. 8 Corona distribution pattern in ionization & collection zone FIG. 9 Schematic drawing for filters in series to improve efficiency FIG. 10 Schematic drawing for Ionization zone positive electrode(s) (4)
Figure 8:
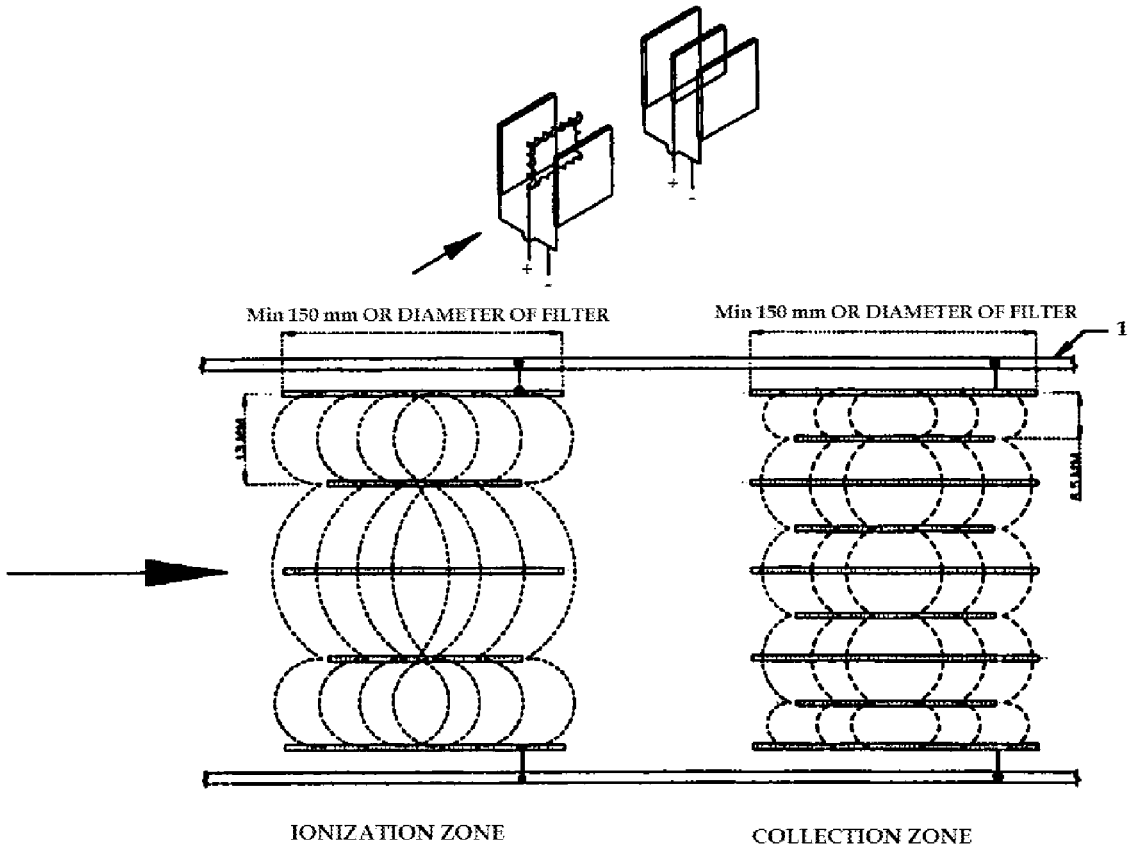
Figure 9:
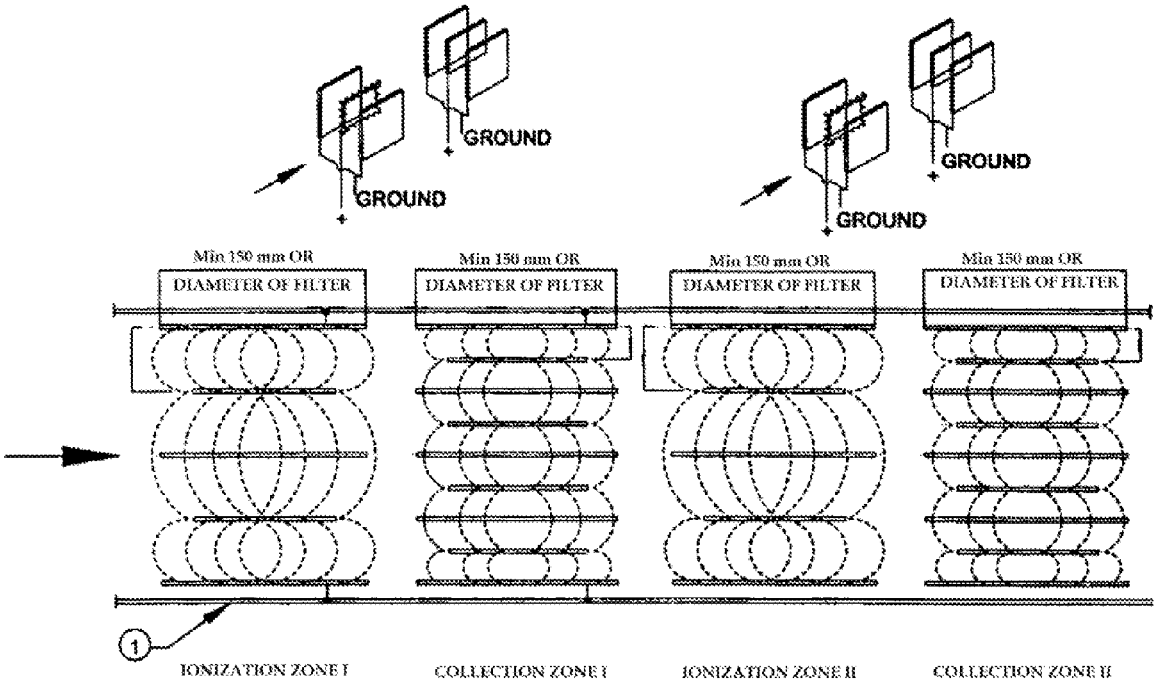

By changing the orientation of filter to vertical with an inlet from the bottom side of the filter and an outlet from the top side of the filter as shown in FIG. 07 makes the cleaning process easier for easy handling and maintenance of filter.

Diffusion pumps have the problem of back streaming of oil fumes to the work chamber it which will effect the process and or contaminate the work chamber. In this case, oil fumes will enter first into the collection zone and then the ionization zone. This will filter all oils fumes from back streaming by more than 98%.

When bacteria, fungi, algae passes through high intensity corona zone this bacterial will be reasonably killed.

Filter to Work in Flame Proof Environment

Even a small accidental back corona/electric spark may ignite flammable fumes presence in side filter. It may ignite fumes if fumes are in between LEL (lower explosive limits) and (UEL) upper explosive limits. Even if fumes get ignited, the rise in pressure in the pipe line and or filter will be 10 times than its actual pressure before ignition takes place. Pressure after ignition is equal to or less than atmospheric pressure. The above is clearly discussed in U.S. Pat. No. 6,888,713 and also US Patent Application No. 20070231162

For majority of gases, ignition cannot occur at pressures lower than 60 mbar (45 Torr). Therefore flammability issues usually arise only after that point in vacuum system where the gas is compressed above this pressure level. The vacuum pressure sensor (18) therefore will be set at the pressure as is required for industrial and safety standards and norms to send signals to electrical circuits of the filter. If vacuum pump trips or stops due to any reason even when vacuum pressure is less than 45 Torr or set point in vacuum pressure sensor (18) the filter electrical supply will be stopped. The mounting of vacuum pressure sensor can be done on filter and or on Vacuum process chamber. As a practice of safety to avoid problems due to malfunction with vacuum pressure sensor we can opt for Dual vacuum pressure sensors also if safety standards are required to be followed to meet specific requirements.

Here special operating practices and procedures as well as equipments such as detonation and flame arrestors may be required on the vacuum line as per industry standards and norms to install filters in flame proof and explosion proof environments. These norms and standards will/may vary from industry to industry, process to process, location to location and country to country. There will always be different standards and norms and practices which would be required to be practiced in the construction of filter and filter safety measures to meet specific requirements to work safe in above said environments.

The same filter can be used in flame proof environment like pharma, bulk drugs, semi-conductor(s) processes etc., with additional flame proof fixtures (17) and flame proof panel (16) in put signal from vacuum pump (27) and Vacuum pressure sensor (18) as per industrial standards and Government regulations as applicable to individual countries for safe operation of filter in flame proof and or explosion environments.

The main filter is controlled by vacuum pump signal (27) and also vacuum pressure sensor (18) when both pump is in running condition and also the vacuum level reached to set point the signal will be sent to the filter electrical control circuit through controller (19) the filter will start functioning sending Ionization and collection currents through (H1 & H2) to Ionize and charge all air borne particles which are passing through to collect same and to stop entry of these impurities in to vacuum pump system. In such cases where flame proof environment filter the filter efficiency will come down and same depends up on the size of chamber to be evacuated, pipe line sizes and distances, minimum vacuum pressure required to put the filter in operation, time required to reach required vacuum level and many more.

The vacuum level set points will depend on flammable impurities and properties presence from vacuum process work chamber under its explosive limits classification as per normal standards and safe practices of regulating authorities and industrial safety norms and standards.

The vacuum connection for vacuum pressure sensor either can be taken from filter housing and/or vacuum process work chamber as per convenience and as per requirement of system.

Design Data

The Diameter of filter will depends on mainly

A) Vacuum pump capacity

B) Impurities presence

C) Periodic cleaning schedule of filter needed

D) Properties of contamination (liquid/solid)

The fluid stream velocity we considered as 0.1 Meters/Second to 2 Meters/Second based on impurities present in fluid stream and cleanliness required.

Stream Flow in Cubic Meters per Seconds=(Q) Speed Meters Per Second=(N).

Cross-sectional Area of Tube in Square meters=(A)=Q/N Dia of Tube=Square Root of (1.3×Area of Tube).

Ionization time (T) is 6 to 30 Milli seconds.

(Again the ionization time depends upon the impurities present and also the cleanliness required).

Then the Length of Each Electrode(s)=Speed of Fluid stream (N)/Ionization time (T).

Based on this formula the length of electrode(s) will be calculated.

Ionization zone potential difference DC Voltage (V1)=up to 12000 VDC.

Collection zone DC input voltage=up to 6000 V DC.

And there will be a collection pot between Ionization and collection zone this collection pot enables top hold more quantity of Liquid contaminants and to hold and dispose safely for some time after collection of liquid impurities from process. The above said equations can be used to decide the filter size approximately.

If the diameter of filter is too big to handle and clean filter electrode(s) assembly manually the filter orientation will be vertical as shown in FIG. 7 for easy cleaning without dismantling of filter from main line.

I claim:

1. A vacuum filter pump system comprising:

(a) an ionization zone, (b) a collection zone, and (c) a diffusion pump, and (d) a work chamber, wherein the ionization zone comprises an insulated diverter and one or more sets of electrodes, wherein the collection zone comprises one or more sets of electrodes, and wherein the diffusion pump is positioned such that backflow of oil and oil fumes first enter the collection zone and then enter the ionization zone, with less than 2% of such oil and oil fumes entering the work chamber.

2. The vacuum pump filter system of claim 1 wherein the one or more sets of ionization zone electrodes are supported by a supporter conductor.

3. The vacuum pump filter system of claim 1 wherein a power supply is connected to the sets of electrodes through a glass to metal, ceramic to metal, or rubber to metal seal wherein said seal seals up to $1\times10^{-6}$ Torr.

4. The vacuum pump filter system of claim 1 wherein the positive and negative electrodes are kept substantially equidistant by covers comprising plastics, rubbers, teflon or ceramic.

5. The vacuum pump filter system of claim 1 wherein gas flow velocity is from 0.1 to 2.0 meters per second.

6. The vacuum pump filter system of claim 1 further comprising an electrically grounded filter housing, wherein the electrically grounded filter housing attracts charged particles, dust, mist or fumes.

7. The vacuum pump filter system of claim 1 wherein each said set of ionization zone electrodes is configured so that a long plate with corona discharge is arranged in the direction of flow such that substantially all particles of a size of 0.3 microns or less are charged.

8. The vacuum pump filter system of claim 1 wherein each said set of collection zone electrodes attracts charged particles, dust, mist and fumes such that the flow is now substantially free of particles of a size of 0.3 microns or less.

* * * * *